United States Patent [19]

Charles

[11] 4,177,012

[45] Dec. 4, 1979

[54] FAN BLADE WITH BENDS FORMING GENERAL BLADE CURVATURE

[75] Inventor: Herbert N. Charles, Chatham, Canada

[73] Assignee: Fram Corporation, East Providence, R.I.

[21] Appl. No.: 886,678

[22] Filed: Mar. 15, 1978

[51] Int. Cl.[2] ..... F04D 29/38

[52] U.S. Cl. ..... 416/132 A; 416/240; 416/DIG. 3

[58] Field of Search ..... 416/132 R, 132 A, 240, 416/DIG. 3, 237

[56] References Cited

U.S. PATENT DOCUMENTS

| | | | |
|---|---|---|---|
| 3,490,686 | 1/1970 | Weir | 416/132 A X |
| 3,910,718 | 10/1975 | MacEwen et al. | 416/132 A |
| 3,914,069 | 10/1975 | Arrington et al. | 416/132 A |
| 4,037,987 | 7/1977 | Charles et al. | 416/132 A |

FOREIGN PATENT DOCUMENTS

| | | | |
|---|---|---|---|
| 2013481 | 10/1970 | Fed. Rep. of Germany | 416/132 |
| 1600744 | 9/1970 | France | 416/237 |

*Primary Examiner*—Everette A. Powell, Jr.

[57] ABSTRACT

An automotive cooling fan having flexible, resilient blades which decamber with increasing rotational speed of the fan, the general curvature of the blades being formed by a multiplicity of spaced, generally radially extending bends in the blades; in preferred embodiments the blades have configuration resulting from said bends in which the general radius of blade curvature of the blades increases and the chord angle of the blades decreases from the blade roots to the blade tips.

6 Claims, 8 Drawing Figures

FIG 4
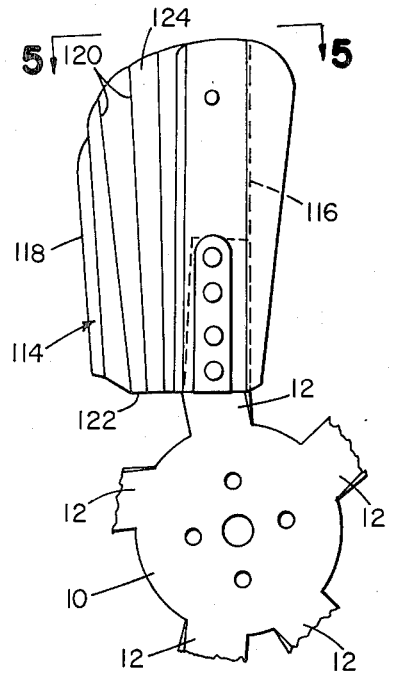
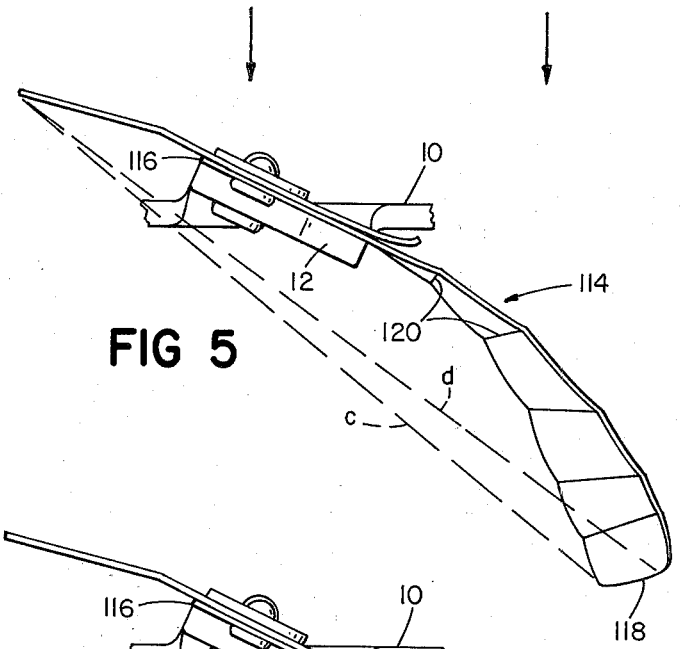
FIG 5
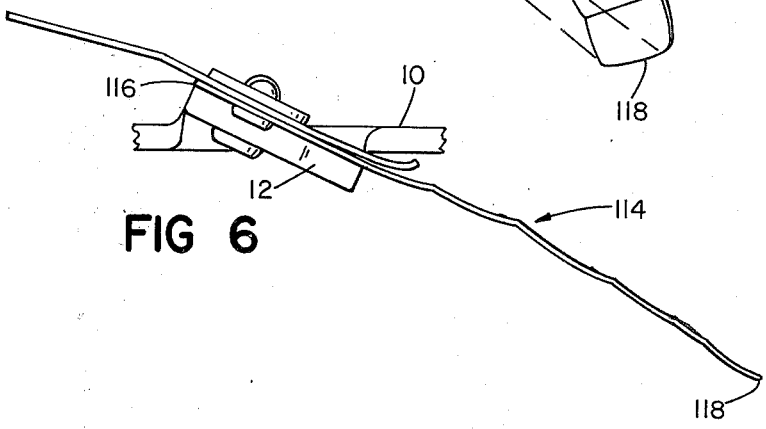
FIG 6
FIG 7
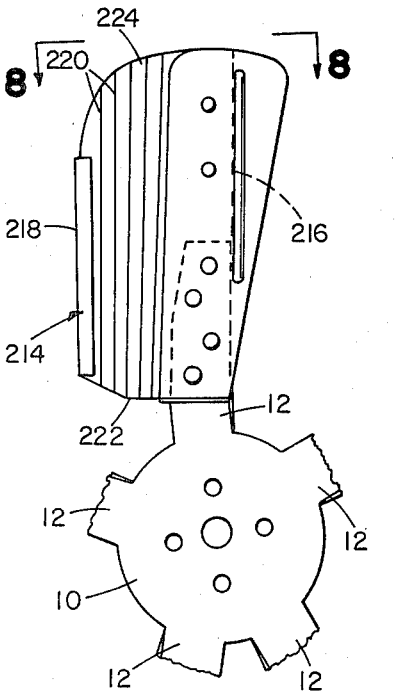
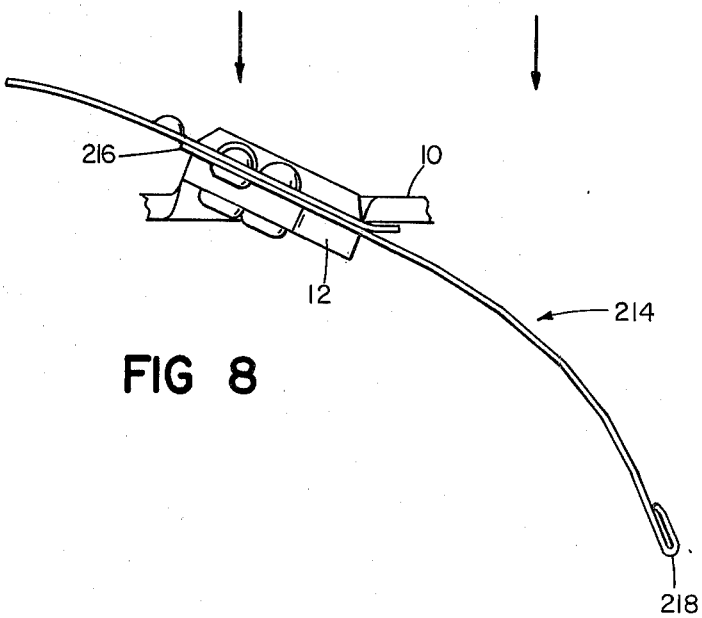
FIG 8

FAN BLADE WITH BENDS FORMING GENERAL BLADE CURVATURE

This invention relates to automotive cooling fans having flexible resilient blades which decamber with increasing rotational speed of the fan and, more particularly, to such a fan in which the blades are formed to provide an improved airfoil configuration.

Flexible blades for automotive cooling fans have typically been formed from stainless steel sheet metal. After stamping the blade from a coil of the sheet metal, the blade has been formed to a uniform camber from the root to the tip, the camber forming a uniform downstream curvature between the leading and trailing edges. Thereafter, the blade is heat treated for stress relief.

In use, at high rotational speeds, such blades develop a reverse-S configuration, at the leading portion, bending back from the normal pitch angle but at the trailing portion maintaining, at least in part, the original downstream curvature. Such a configuration is not an efficient one for an airfoil. A previous suggestion to eliminate this reverse-S configuration is illustrated in U.S. Pat. No. 3,836,284, and utilizes a separate support member to restrain the blade; such a separate member adds undesirable weight to the fan in addition to cost.

The uniform curvature of the blades is also less than ideal since the rotational velocity at the root is lower than at the tip of a blade. Preferably, the chord angle of the blade to the plane of rotation is smaller at the tip than at the root of the blade to provide relatively uniform airflow across the blade radial extent. Copending application, Ser. No. 843,564, filed Oct. 19, 1977, discloses varying the chord angle by prestressing the blade root with a biasing member. It is desirable, however, to provide the varying chord angle in the blade either without use of a biasing member, to avoid its additional weight, or in combination with a biasing member to thus provide greater design choice.

Accordingly, it is a principal object of this invention to provide a flexible, resilient fan blade having, in use, an improved airfoil configuration. It is a further object of this invention, to minimize the tendency of such a blade to assume a reverse curvature at high speeds. It is a further object in particular embodiments of this invention to provide such a fan blade having a greater chord angle at the root than at the tip of the blade which will thus tend to produce uniform airflow across the radial extent of the blade.

In general, the invention features a fan having a plurality of generally radially extending fan blades of flexible, resilient fan blade material. The blades are secured at their leading edges to arms radially projecting from a fan hub. The blades extend transversely behind the blades to trailing edges and the blades are curved in a downstream direction between the leading and trailing edges, being free to decamber in an upstream direction as fan rotational speed increases. The fan, according to the invention is characterized in that each blade is provided with a multiplicity of generally radially extending, spaced apart bends between the leading and trailing edges behind the fan arms forming the general downstream curvature of the blade.

In a particular embodiment, the bends in each blade are parallel to each other and extend from the root to the tip of the blade, the camber of the blade being uniform from the root to the tip.

In other embodiments, the bends are formed to control the blade camber such that the blade has a greater chord angle to the plane of rotation at the root than at the tip. In one such embodiment the bends extend from the root a limited distance toward the tip, the tip portion of the blade free of bends; the bends in this embodiment may be parallel to each other. In another such embodiment the bends extend from the root along lines successively diverging rearwardly toward the trailing edge from a generally radial line adjacent the leading edge; the bends in this embodiment may extend to the blade tip.

Other objects, features and advantages of this invention will be apparent to those skilled in the art from the following detailed description of preferred embodiments thereof, taken together with the accompanying drawings, in which:

FIG. 4 is a fragmentary plan view of another embodiment of a fan according to the invention;

FIG. 5 is an enlarged end view of a blade taken along the line 5—5 of FIG. 4;

FIG. 6 is a view similar to that of FIG. 5 somewhat schematically illustrating the blade of FIG. 5 fully decambered in use;

FIG. 7 is a fragmentary plan view of yet another embodiment of a fan according to the invention; and FIG. 8 is an enlarged end view taken along the line 8-8 of FIG. 7.

Figure 1:
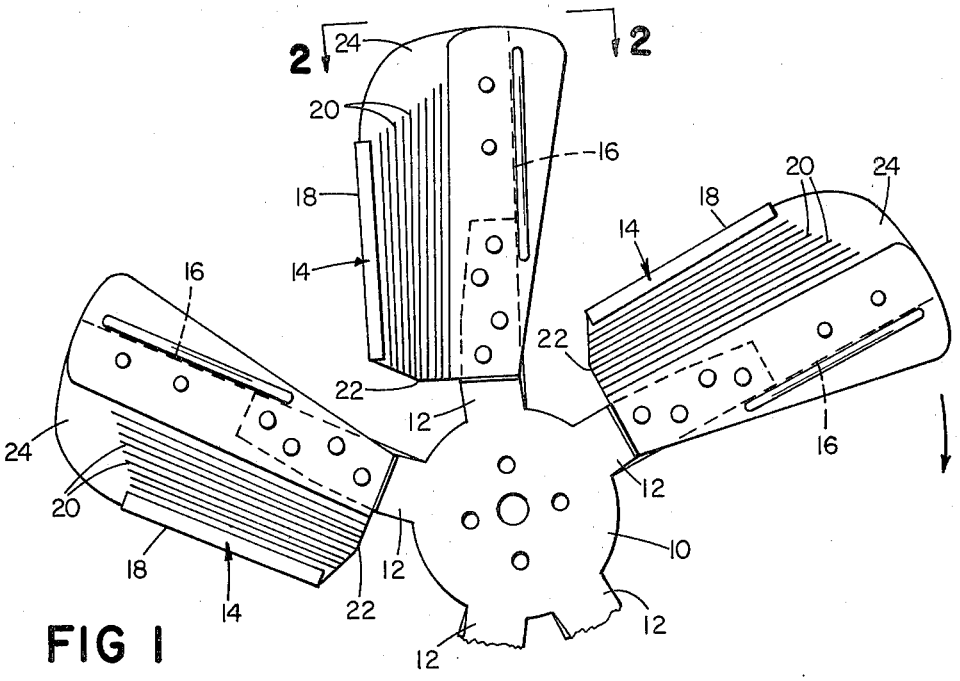
FIG. 1 is a fragmentary plan view of one embodiment of a fan according to the invention.

Referring now to FIGS. 1, 4 and 7 of the drawings, the fans each comprise a rigid spider having a hub 10 and a plurality of integral arms 12 projecting radially from the hub. Blades 14, 114, 214 are secured at their leading edges 16, 116, 216, defined by the direction of fan rotation, to arms 12 and extend transversely behind arms 12 to trailing edges 18, 118, 218. The blades 14, 114, 214 have a general curvature in the downstream direction, relative to the direction of airflow. The blade material is flexible and resilient, e.g., AISI 301 stainless steel 0.015 inch thick, to permit the blades 14, 114, 214 to decamber with increasing rotational speed of the fan.

As illustrated in FIGS. 1, 4 and 7 each of the blades 14, 114, 214 is formed with a multiplicity of generally radially extending, spaced apart bends 20, 120, 220 behind arms 12 which extend from the blade roots 22, 122, 222, adjacent each hub 10, to the blade tips 24, 124, 224, remote from the hubs 10. The blade downstream curvature is formed entirely by the bends.

Figure 2:
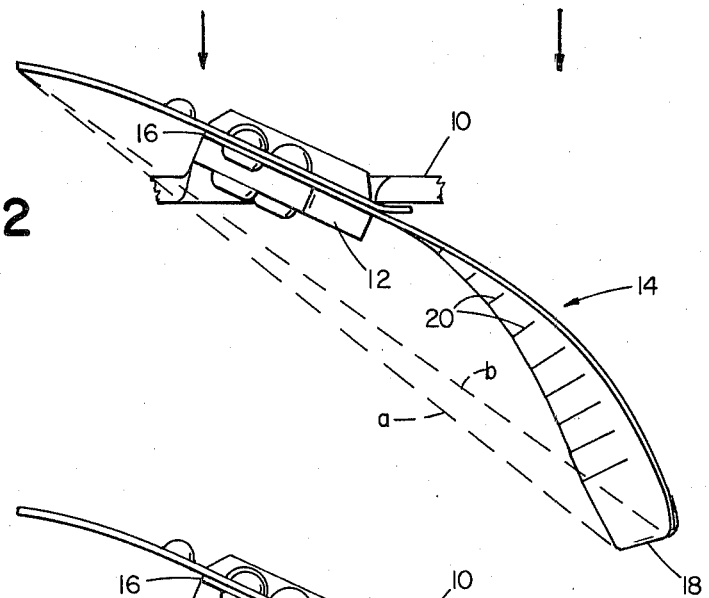
FIG. 2 is an enlarged end view of a blade taken along the line 2—2 of FIG. 1.

In one embodiment, illustrated best in FIGS. 1 and 2, the bends 20 extend from the blade root 22 a limited distance toward the blade tip 24, the tip being free of bends. The bends are parallel to each other. The resistance of the unbent blade material to the bending stresses imposed by the bends extending outwardly from the root results in the general radius of curvature of the blade increasing progressively from the root to the blade tip; the chord angle a at the root, relative to the plane of rotation in which hub 10 lies, decreases to chord angle b at the tip.

In the embodiment, illustrated in FIGS. 4 and 5, the bends 120 extend from the blade root 122 to the tip 124. The bends 120 extend along lines successively diverging rearwardly toward the trailing edge 118 from a radial line adjacent the leading edge. The diverging bends result, as in the previous embodiment, in the chord angle c at the root decreasing to a chord angle d at the tip, i.e., the general radius of curvature increases progressively toward the tip.

In the embodiment illustrated in FIGS. 7 and 8, the bends 220 are parallel to each other and extend from the root to the tip. In this embodiment the curvature of the blade is uniform throughout its length.

In making the blades the bends may be formed in dies in a conventional press. The bend radius is preferably about 0.125 inch and the angle between adjacent sections of material on each side of a bend is in the range of 10–30°. The chord angles a and c are about 40–45° and the chord angles b and d are about 35° in the embodiments of FIGS. 2 and 5. Due to the resilience of the blade material, the dies are preferably designed to bend the material beyond its final design dimension. After bending the blades are heat treated for stress relief.

Figure 3:
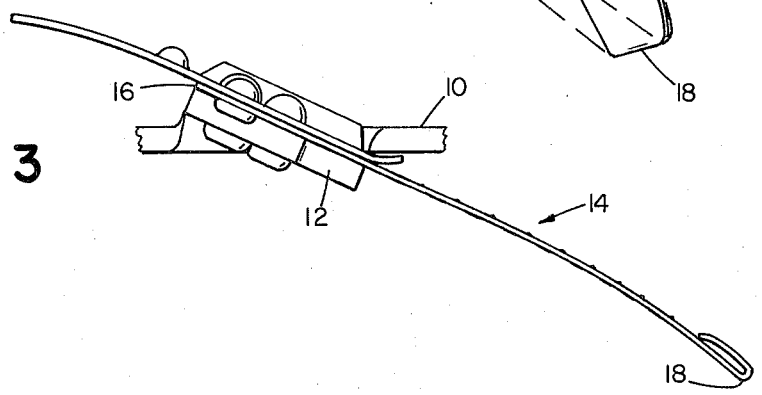
FIG. 3 is a view similar to that of FIG. 2 somewhat schematically illustrating the blade of FIG. 2 fully decambered in use.

In operation, as illustrated in FIGS. 3 and 6, when the blade is significantly deflected it does not develop an overall reverse S curvature. Although the material between bends tends to develop a reverse curvature, the overall configuration is relatively straight. This is true also of the embodiment illustrated in FIGS. 7 and 8, though not specifically there shown. The elimination of the reverse S curvature improves the airflow performance of the fan at high speeds. In the embodiments illustrated in FIGS. 1–8 the varying chord angle provides improved airflow performance, particularly uniformity, at both low and high speeds.

Other embodiments of this invention will occur to those skilled in the art which are within the scope of the following claims.

What is claimed is:

1. An automotive cooling fan comprising a plurality of generally radially extending fan blades of flexible, resilient blade material secured to arms of a fan spider projecting radially from a hub, said blades fastened to said arms at their leading edges, defined by the direction of fan rotation, and extending transversely behind said blades to trailing edges, said blades curved in a downstream direction, relative to the direction of air flow, between said leading and trailing edges, and said blades free to flex and decamber in an upstream direction with increasing rotational speeds, characterized in that a multiplicity of generally radially extending bends are provided in each said flexible, resilient blade between said leading and trailing edges behind said arm said bends spaced apart and forming the downstream general curvature of said blade.

2. The fan claimed in claim 1 further characterized in that said bends are parallel to each other extending the length of said blade from the blade root, adjacent said hub, to the blade tip, remote from said hub, and the blade material is unstressed between said bends.

3. The fan claimed in claim 1 further characterized in that said bends extend from the blade root, adjacent the hub, a limited distance toward the blade tip, remote from the hub, and the blade material at the blade tip is free of said bends, said blade thereby formed to a configuration in which the general radius of curvature of said blade increases and the chord angle of said blade to the plane of fan rotation decreases progressively along said blade from the blade root to the blade tip.

4. The fan claimed in claim 3 further characterized in that said bends are parallel to each other.

5. The fan claimed in claim 1 further characterized in that said bends extend from the blade root, adjacent the hub, toward the tip, remote from the hub, along lines successively diverging rearwardly toward the trailing edge from a generally radial line adjacent the leading edge, said blade thereby formed to a configuration in which the general radius of curvature of said blade increases and the chord angle of said blade to the plane of fan rotation decreases progressively along said blade from the blade root to the blade tip.

6. The fan claimed in claim 5 further characterized in that said bends extend to the blade tip.

* * * * *